US008613294B2

(12) United States Patent
Yeh

(10) Patent No.: US 8,613,294 B2
(45) Date of Patent: Dec. 24, 2013

(54) FAUCET ASSEMBLY

(75) Inventor: Chia-Chang Yeh, Changhua Hsien (TW)

(73) Assignee: Alexander Yeh Industry Co., Ltd., Lukang Chen, Changhua Hsien (TW)

( * ) Notice: Subject to any disclaimer, the term of this patent is extended or adjusted under 35 U.S.C. 154(b) by 255 days.

(21) Appl. No.: 13/028,199

(22) Filed: Feb. 15, 2011

(65) Prior Publication Data

US 2012/0204987 A1 Aug. 16, 2012

(51) Int. Cl.
*E03C 1/042* (2006.01)

(52) U.S. Cl.
USPC ..... 137/801; 137/360; 4/678; 4/696

(58) Field of Classification Search
USPC ..... 137/801, 360; 285/8; 4/678, 696
See application file for complete search history.

(56) References Cited

U.S. PATENT DOCUMENTS 3,136,570 A * 6/1964 Lee ..... 285/193
6,175,972 B1 * 1/2001 Wales ..... 4/678
6,267,145 B1 * 7/2001 Sun ..... 137/801
6,840,267 B1 * 1/2005 Jennings et al. ..... 137/360
7,373,674 B1 * 5/2008 Condon ..... 4/678
8,376,249 B2 * 2/2013 Huang ..... 239/587.5
8,408,240 B2 * 4/2013 Huang ..... 137/360
8,408,241 B2 * 4/2013 Huang ..... 137/360
8,424,558 B2 * 4/2013 Huang ..... 137/360
8,424,559 B2 * 4/2013 Huang ..... 137/360

* cited by examiner

*Primary Examiner* — Craig Schneider

(57) ABSTRACT

A faucet assembly has: a faucet body having a containment space with an opening, the opening having a water outlet with an assembly tube extending into the containment space; a connecting tube disposed in the containment space of the faucet body, an end of the connecting tube having a connecting section connected to the assembly tube, another end of the connecting section having a securing section adjacent to the opening, the securing section having an inner threaded section on an inner sidewall; and a tube-shaped coupling member having an axial connecting aperture, an end of the coupling member having an outer threaded section, another end of the coupling member having a narrowed section with an axial screw aperture connected to the connecting aperture, a screw member locked with the screw aperture, and the inner threaded section of the connecting tube locked with the outer threaded section of the coupling member.

2 Claims, 6 Drawing Sheets

FAUCET ASSEMBLY

BACKGROUND OF THE INVENTION

1. Field of the Invention

The present invention relates to a faucet assembly, and more particularly to a simplified faucet assembly.

2. Description of the Related Art

A prior art faucet assembly, as shown in FIG. 5 and FIG. 6, comprises a connecting frame 40, a securing hook 50, a tightening member 60, a connecting tube 70 and a cover 80. The connecting frame 40 has a circular disk 41 and a through aperture 42 disposed in the circular disk 41. A containment space 43 is formed around the through aperture 42 on one side of the connecting frame 40, and a protrusion portion 44 is formed on another side of the circular disk 41. The protrusion 44 also includes a sealing ring 45. The securing hook 50 is a clamp disposed in the containment space 43, and has a tightening hole 51 corresponding to the through aperture 42. The securing hook 50 further has a slot 52 coupled with to the tightening hole 51 and two wings 53 are respectively set on two sides of the slot 52. The wings 53 are capable of being secured with a sleeve 54 and a bolt 55. The tightening member 60 is engaged with the protrusion portion 44. One end of the connecting tube 70 has a connecting portion 71, and another end of the connecting tube 70 has a conjunction portion 72 for engaging with the tightening member 60. The cover 80 covers the connecting tube 70 and the connecting frame 40, and the cover 80 is attached onto the circular disk 41 of the connecting frame 40.

When the faucet assembly is to be installed onto the intake tube B, the securing hook 50 first is placed in to the containment space 43 of the connecting frame 40, the through aperture 42 and the tightening hole 51 are jacketed onto the intake tube B, and then the tightening member 60 is engaging with the protrusion 44 of the connecting frame 40. The sleeve 54 and the bolt 55 are placed through the wings 53 of the securing hook 50 to compress the slot 52, such that the tightening hole 51 is tightened on intake tube B, which completes the connection between the connecting frame 40 and the intake tube B. The connecting portion 71 of the connecting tube 70 is locked in the cover 80, the conjunction portion 72 of the connecting tube 70 is jacketed onto the tightening member 60, and finally the cover 80 is jacketed onto the circular disk 41 of the connecting frame 40.

However, the above-mentioned prior art has following obvious drawbacks:

1. The assembly procedure is complicated and difficult, which creates inconvenience.

2. The prior art structure includes the connecting frame 40, the securing hook 50, the tightening member 60 and the connecting tube 70, which further requires the sleeve 54 and the bolt 55 to secure the securing hook 50; therefore, it requires too many elements and has higher associated material costs.

Therefore, it is desirable to provide a faucet assembly to mitigate and/or obviate the aforementioned problems.

SUMMARY OF THE INVENTION

An objective of the present invention is to provide a faucet assembly, which is much easier to assemble.

A coupling member is used for connecting together an intake tube and a connecting tube; a screw member of the coupling member is screwed into a screw aperture, and the screw member moves towards a connecting aperture to tighten onto the intake tube such that the coupling member and the intake tube are securely connected. An inner threaded section is then screwed onto an outer threaded section of the coupling member to firmly connect the intake tube, the coupling member and the connecting tube together.

Another objective of an embodiment of the present invention is that the faucet body utilizes the screw member of the coupling member to tighten onto the intake tube, and the connecting tube is locked onto the coupling member to secure the faucet body. Embodiments of the present invention not only can be quickly assembled and provide greater strength but also require fewer assembly parts, which can reduce manufacturing costs.

Another objective of embodiments of the present invention is that a sealing sleeve is disposed adjacent to the sealing face, and the sealing face is placed in the securing section and pressed by the sealing sleeve against a first stopping face and a second stopping face.

A faucet assembly comprises a faucet body, a connecting tube and a coupling member. The faucet body has a containment space with an opening, and the opening has a water outlet, and the water outlet has an assembly tube extending into the containment space. A connecting tube is disposed in the containment space of the faucet body, an end of the connecting tube having a connecting section, the connecting section connected to the assembly tube, another end of the connecting section having a securing section adjacent to the opening, the securing section having an inner threaded section on an inner sidewall. A tube-shaped coupling member has an axial connecting aperture, an end of the coupling member having an outer threaded section, and another end of the coupling member having a narrowed section. The narrowed section has an axial screw aperture connected to the connecting aperture, a screw member locked with the screw aperture, and the inner threaded section of the connecting tube is locked with the outer threaded section of the coupling member to secure the faucet body.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
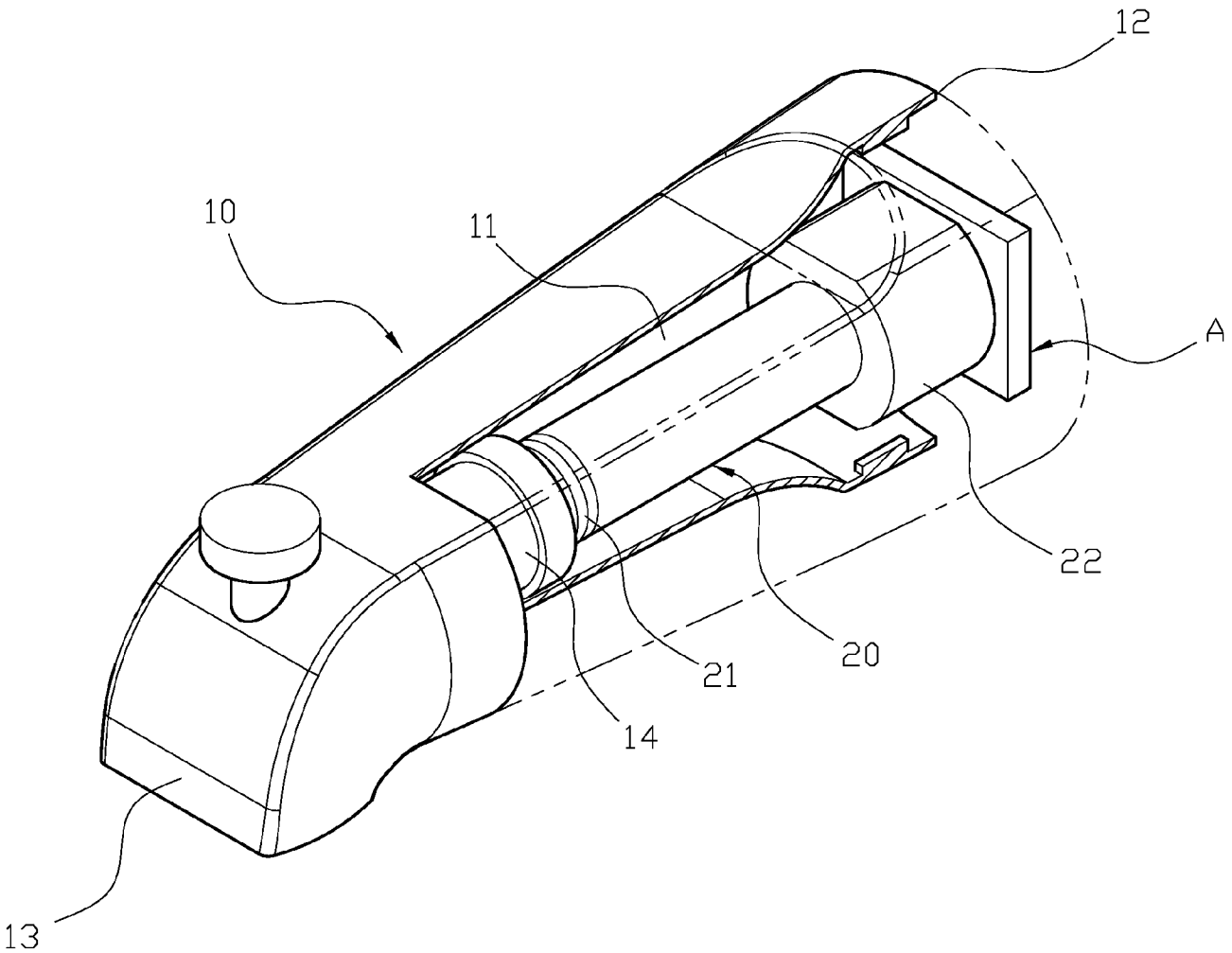
FIG. 1 is a perspective view of an embodiment of the present invention.
Figure 2:
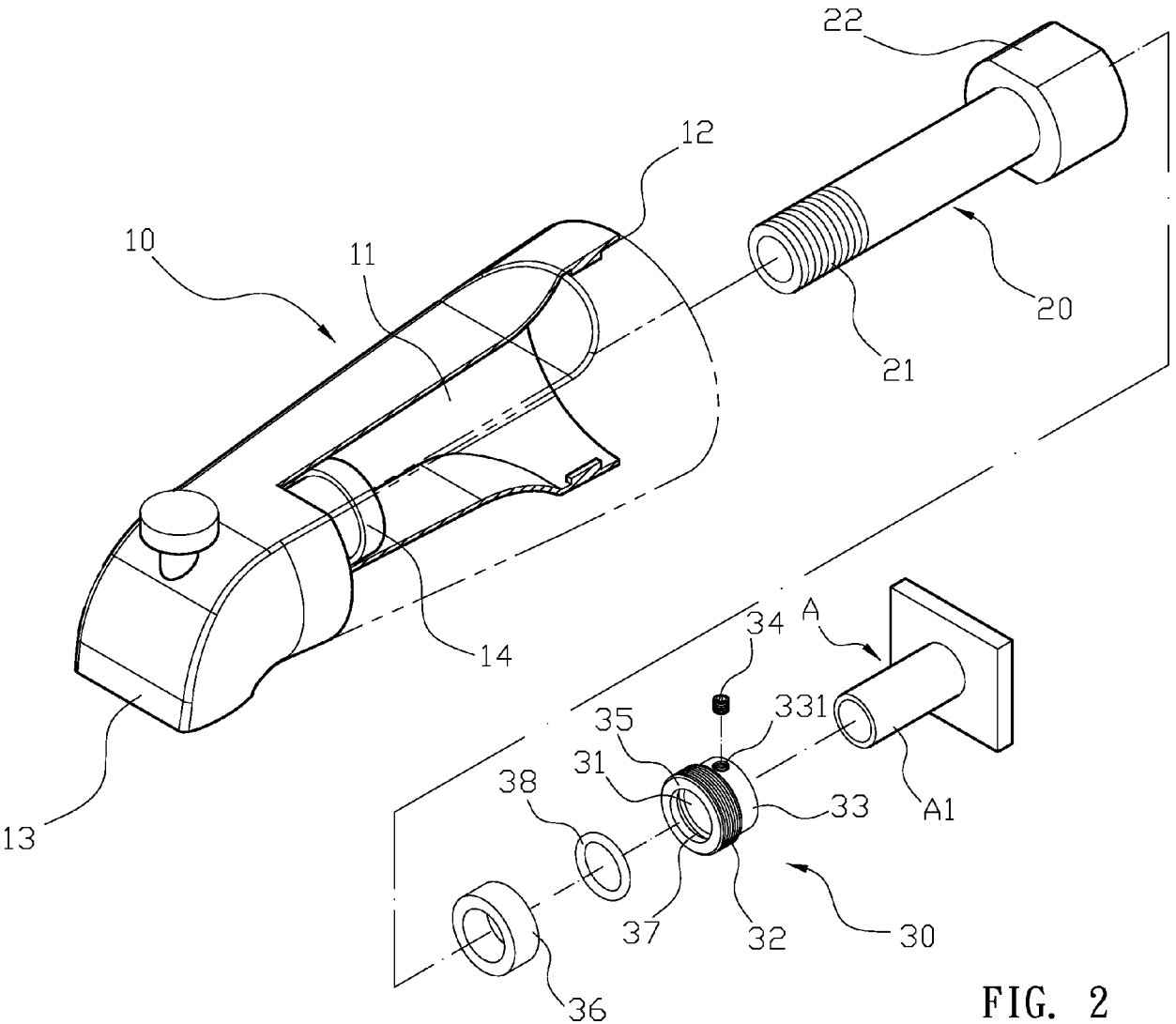
FIG. 2 is an exploded view of the embodiment of the present invention.
Figure 3:
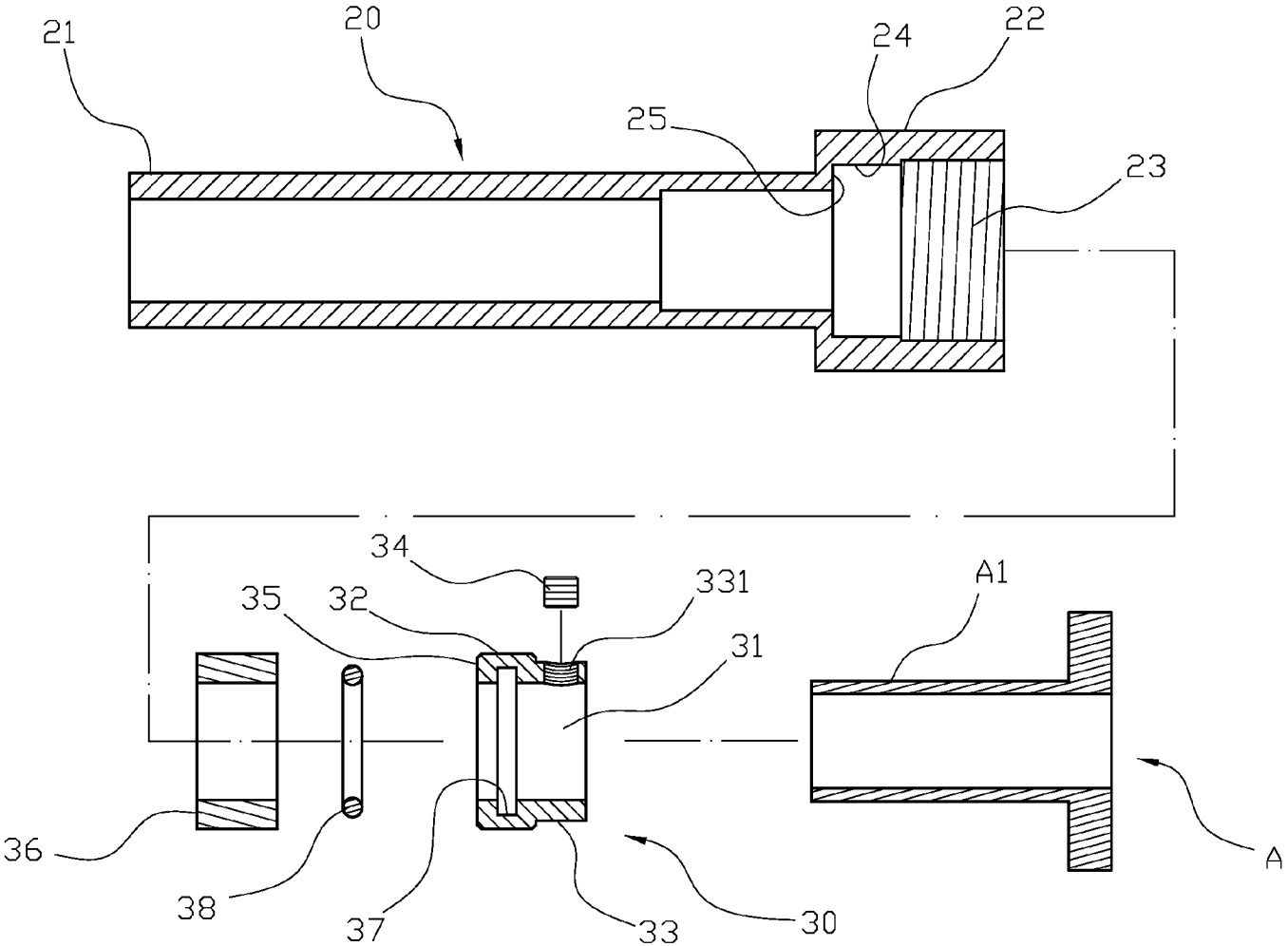
FIG. 3 is a cross-sectional view of the embodiment of the present invention.

Please refer to FIGS. 1, 2 and 3. A faucet assembly comprises a faucet body 10, a connecting tube 20 and a coupling member 30. The faucet body 10 has a containment space 11 with an opening 12, and the opening 12 has a water outlet 13, and the water outlet 13 has an assembly tube 14 extending into the containment space 11. A connecting tube 20 is disposed in the containment space 11 of the faucet body 10, an end of the connecting tube 20 has a connecting section 21, and the connecting section 21 is connected to the assembly tube 14. Another end of the connecting section 21 has a securing section 22 is adjacent to the opening 12, and the securing section 22 has an inner threaded section 23 on an inner sidewall. A tube-shaped coupling member 30 has an axial connecting aperture 31, an end of the coupling member 30 has an outer threaded section 32, and another end of the coupling member 30 has a narrowed section 33. The narrowed section 33 has an axial screw aperture 331 connected to the connecting aperture 31, a screw member 34 locked with the screw aperture 331. Furthermore, the securing section 22 further comprises a first stopping face 24 and a second stopping face 25 that extends into the inner threaded section 23, and the coupling member 30 has a sealing face 35 at a free end of the outer threaded section 32. A sealing sleeve 36 is disposed adjacent to the sealing face 35, and the sealing face 35 is placed in the securing section 22 and pressed by the sealing sleeve 36 against the first stopping face 24 and the second stopping face 25. The coupling member 30 further comprises a sealing slot 37 around an inner wall of the connecting aperture 31 at the end with the outer threaded section 32, and a sealing ring 38 is disposed in the sealing slot 37. In this embodiment, An intake tube A has a round tube section A1 inserted into the connecting aperture 31 of the coupling member 30 and contacting the sealing ring 38, and the coupling member 30 utilizes the screw member 34 to connect to the round tube section A1 such that the intake tube A is connected to the connecting tube 20. The inner threaded section 23 of the connecting tube 20 is locked with the outer threaded section 32 of the coupling member 30 to secure the faucet body 10.

Figure 4:
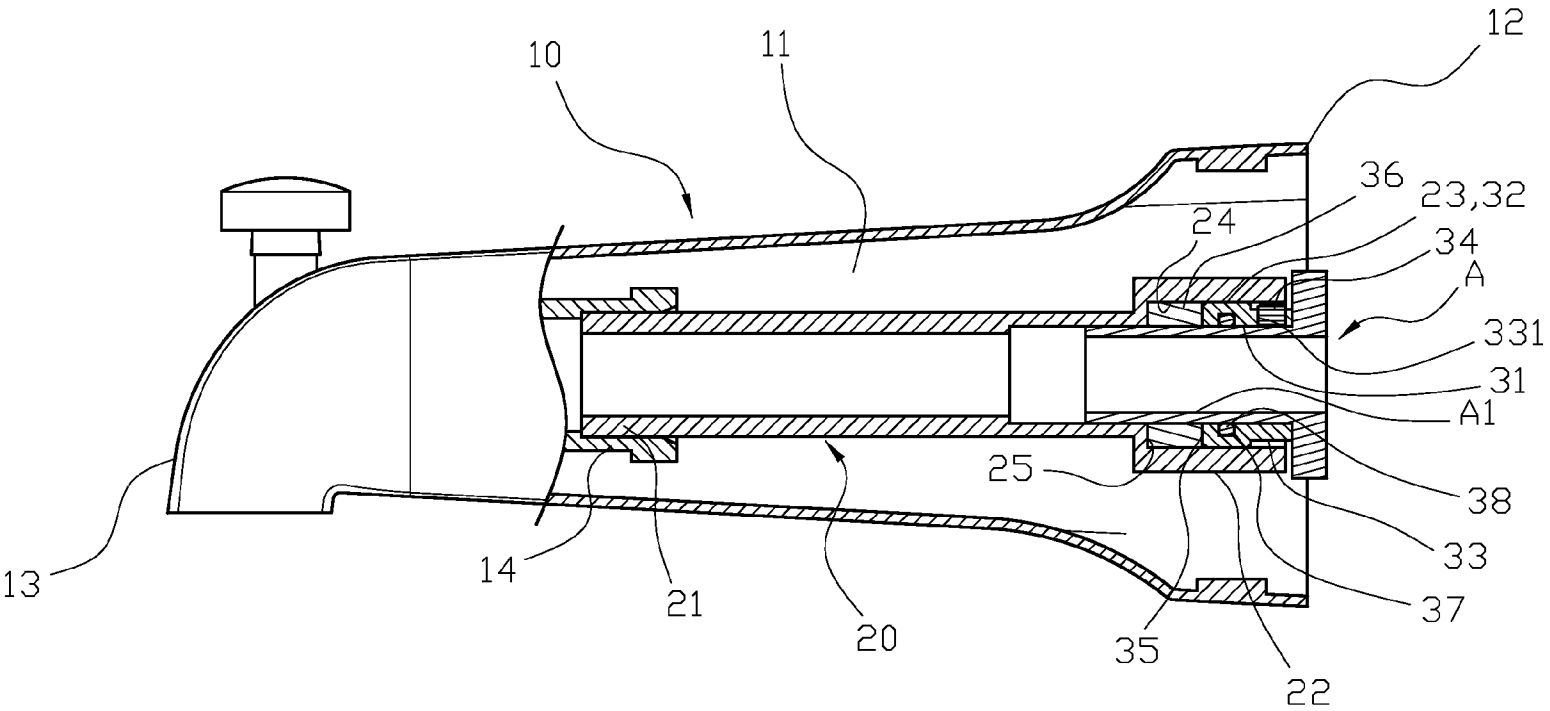
FIG. 4 is a cross-sectional view of the assembled embodiment of the present invention.
Figure 5:
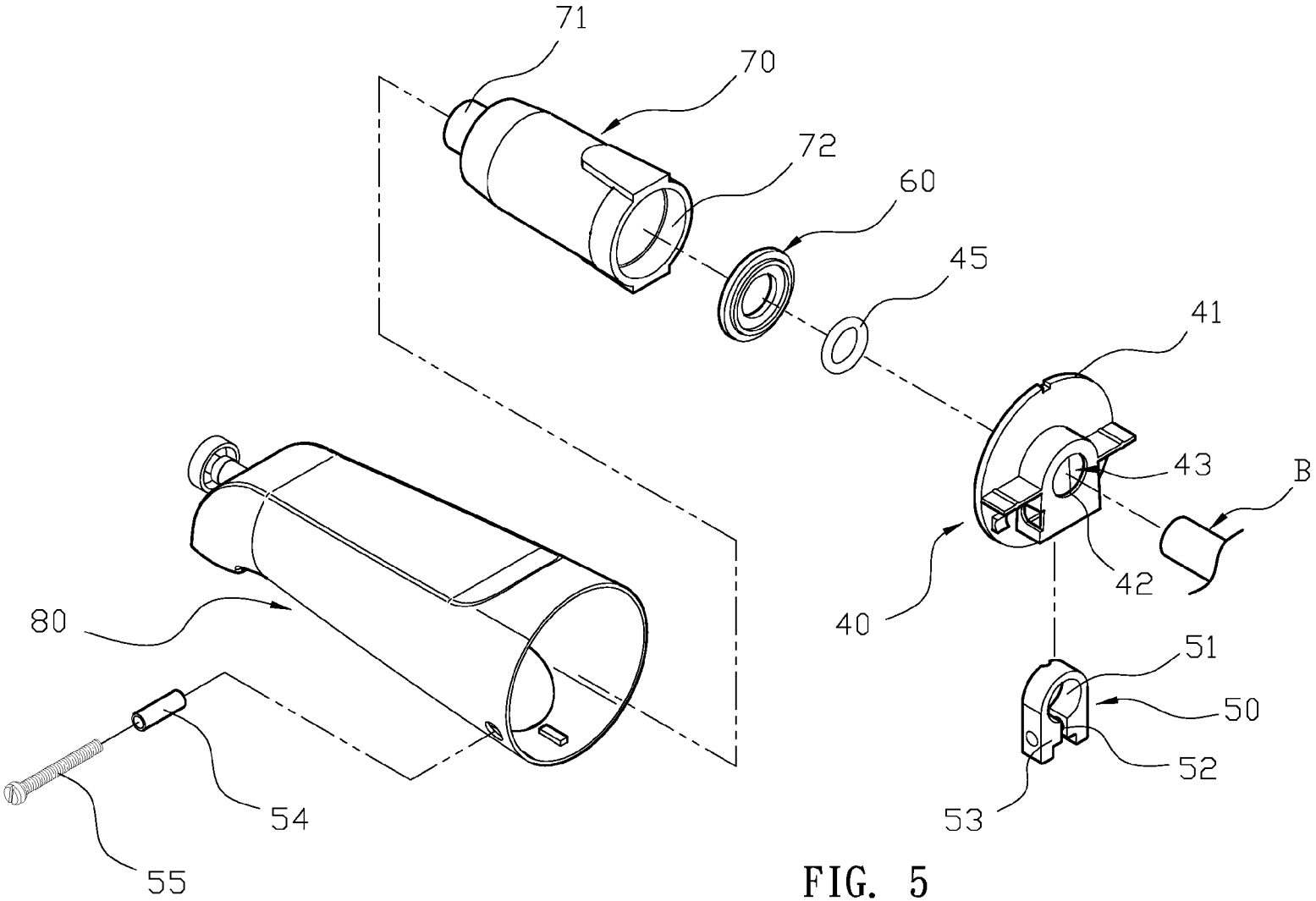
FIG. 5 PRIOR ART
FIG. 5 is an exploded view of a prior art.
Figure 6:
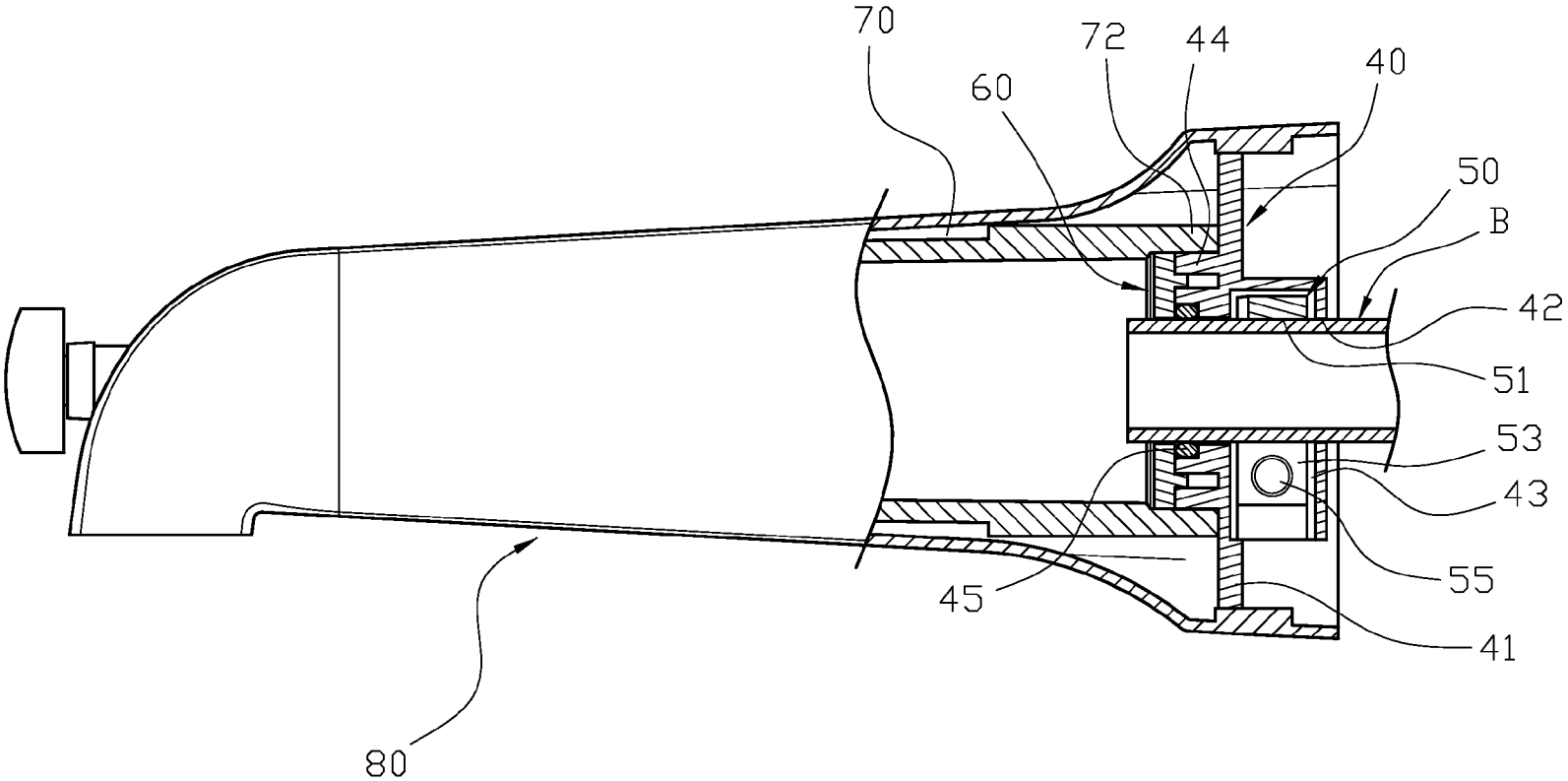
FIG. 6 PRIOR ART
FIG. 6 is a cross-sectional view of the assembled prior art.

For actual assembly, please refer to FIG. 2 to FIG. 4. The coupling member 30 has the sealing ring 38 placed in the sealing slot 37 and the connecting aperture 31 is jacketed onto round tube section A1 of the intake tube A. The sealing face 35 of the coupling member 30 faces the free end of the round tube section A1, and the sealing ring 38 is used to seal the coupling member 30 and the intake tube A together to prevent leakage. The screw member 34 is screwed into the screw aperture 331 of the coupling member 30 and moves towards the end with the connecting aperture 31. The screw member 34 is locked on the round tube section A1 placed in the connecting aperture 31, such that the coupling member 30 and the intake tube A are secured together. Moreover, the free end of the round tube section A1 is disposed in the sealing sleeve 36, and the sealing sleeve 36 is pushed against the sealing face 35 of the coupling member 30. The securing section 22 of the connecting tube 20 is jacketed onto the coupling member 30, and the inner threaded section 23 of the securing section 22 is screwed onto the outer threaded section 32 of the coupling member 30, such that the sealing sleeve 36 is pushed against the first stopping face 24 and the second stopping face 25 of the connecting tube 20. Consequently, the connecting tube 20 and the coupling member 30 are connected, and the coupling member 30 securely connects the connecting tube 20 and the intake tube A together. The faucet body 10 is then placed to cover the connecting tube 20 and connected to the connecting section 21 of the connecting tube 20 by the assembly tube 14 of the water outlet 13, such that the intake tube A, the connecting tube 20 and the assembly tube 14 are all connected all the way through. The above-mentioned assembly procedure is simple and fast.

With the above-mention embodiment, the following benefits can be obtained: 1. The coupling member 30 is used for connecting together the intake tube A and the connecting tube 20, the screw member 34 of the coupling member 30 is screwed into the screw aperture 331, and the screw member 34 moves towards the connecting aperture 31 to tighten onto the intake tube A such that the coupling member 30 and the intake tube A are securely connected. The inner threaded section 23 is then screwed onto the outer threaded section 32 of the coupling member 30 to firmly connect the intake tube A, the coupling member 30 and the connecting tube 20 together. 2. The faucet body 10 utilizes the screw member 34 of the coupling member 30 to tighten onto the intake tube A, and the connecting tube 20 is locked onto the coupling member 30 to secure the faucet body 10. The structure of the embodiment of the present invention not only can be quickly assembled and provide stronger strength but also requires fewer assembly parts, which can reduce manufacturing costs. 3. The coupling member 30 has the sealing sleeve 36 adjacent to the sealing face 35, and the sealing sleeve 36 pushes against the first stopping face 24 and the second stopping face 25 of the connecting tube 20 to improve the sealing effect between the coupling member 30 and the connecting tube 20.

Although the present invention has been explained in relation to its preferred embodiment, it is to be understood that many other possible modifications and variations can be made without departing from the spirit and scope of the invention as hereinafter claimed.

What is claimed is:

1. A faucet assembly comprising:

a faucet body having a containment space with an opening, the opening having a water outlet, and the water outlet having an assembly tube extending into the containment space;

a connecting tube disposed in the containment space of the faucet body, an end of the connecting tube having a connecting section, the connecting section connected to the assembly tube, another end of the connecting section having a securing section adjacent to the opening, the securing section having an inner threaded section on an inner sidewall; and a tube-shaped coupling member having an axial connecting aperture, a first end of the coupling member having an outer threaded section, a second end of the coupling member having a narrowed outer section relative to the first end, the narrowed section having a screw aperture connecting to the connecting aperture, a screw member engaged with the screw aperture, and the inner threaded section of the connecting tube threadedly engaged with the outer threaded section of the coupling member to secure the faucet body, the coupling member further comprising a sealing slot around an inner wall of the connecting aperture of the first end, and a sealing ring disposed in the sealing slot;

wherein the securing section further comprises a first stopping face and a second stopping face that extends to the inner threaded section, and the coupling member has a sealing face at an end of the outer threaded section, and wherein a sealing sleeve is disposed adjacent to the sealing face, the sealing face disposed in the securing section and pressing the sealing sleeve against the first stopping face and the second stopping face.

2. The faucet assembly as claimed in claim 1 further comprising: an intake tube having a round tube section inserted into the connecting aperture of the coupling member and contacting the sealing ring, and the coupling member utilizes the screw member to connect to the round tube section such that the intake tube is connected to the connecting tube.

* * * * *